US007512349B2

(12) United States Patent
Itoh et al.

(10) Patent No.: US 7,512,349 B2
(45) Date of Patent: Mar. 31, 2009

(54) IMAGE FORMING APPARATUS AND METHOD FEATURING CORRECTION FOR COMPENSATING DIFFERENCES IN SURFACE POTENTIAL CHARACTERISTICS OF AN IMAGE SUPPORTING BODY

(75) Inventors: Isami Itoh, Mishima (JP); Tetsuya Atsumi, Susono (JP); Masatsugu Toyonori, Sunto-gun (JP); Tomohito Ishida, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 317 days.

(21) Appl. No.: 11/491,025

(22) Filed: Jul. 24, 2006

(65) Prior Publication Data

US 2007/0025747 A1 Feb. 1, 2007

(30) Foreign Application Priority Data

Jul. 29, 2005 (JP) ..... 2005-221585

(51) Int. Cl.
*G03G 15/00* (2006.01)
*G03G 13/04* (2006.01)
*B41J 2/385* (2006.01)

(52) U.S. Cl. ..... 399/38; 347/133; 399/51

(58) Field of Classification Search ..... 399/38, 399/51, 48, 26, 128; 347/132, 133, 246
See application file for complete search history.

(56) References Cited

U.S. PATENT DOCUMENTS 5,049,939 A 9/1991 Koichi
5,305,057 A * 4/1994 Hattori et al.
5,694,637 A * 12/1997 Yoshino et al. ..... 399/38
6,072,512 A * 6/2000 Fukasawa ..... 399/51
6,205,306 B1 3/2001 Ishida
6,466,244 B2 * 10/2002 Itoh ..... 347/132
2002/0027591 A1 3/2002 Itoh ..... 347/132
2003/0156180 A1 8/2003 Koga et al. ..... 347/129
2004/0170440 A1 9/2004 Hirobe et al. ..... 399/27

FOREIGN PATENT DOCUMENTS

EP 0 768 580 A2 4/1997
JP 01088568 A * 4/1989
JP 2002-67387 3/2002

* cited by examiner

*Primary Examiner*—Susan S Lee
(74) *Attorney, Agent, or Firm*—Fitzpatrick, Cella, Harper & Scinto

(57) ABSTRACT

An image forming apparatus includes an electrophotographic photoconductive body for forming an electrostatic latent image thereon; an exposure device for exposing the electrophotographic photoconductive body to form an electrostatic latent image; a storage device for storing information related to potential characteristics at a plurality of areas divided on a surface of the electrophotographic photoconductive body in advance; an information obtaining device for obtaining the information related to potential characteristics, wherein light quantities exposed by the exposure device are determined according to the information related to potential characteristics stored by the storage device and the information related to potential characteristics obtained by the information obtaining device.

26 Claims, 10 Drawing Sheets

LONGITUDINAL DIRECTION OF PHOTOCONDUCTIVE BODY

ROTATIONAL DIRECTION OF PHOTOCONDUCTIVE BODY

| | | | | | | | | |
|---|---|---|---|---|---|---|---|---|
| D | D | C | C | C | B | B | C | E |
| E | F | E | D | C | C | B | A | B |
| D | F | F | E | D | B | B | C | B |

FIG.3

IMAGE FORMING APPARATUS AND METHOD FEATURING CORRECTION FOR COMPENSATING DIFFERENCES IN SURFACE POTENTIAL CHARACTERISTICS OF AN IMAGE SUPPORTING BODY

BACKGROUND OF THE INVENTION

1. Field of the Invention

The present invention relates to an image forming apparatus and method, and more particularly to an image forming apparatus and method having a developing unit using electrophotography and electrostatic recording.

2. Description of the Related Art

As an electrophotographic image forming apparatus that electrostatically transfers a toner image, which is electrostatically formed on the surface of a photoconductive body functioning as a supporting body, onto a recording material (such as paper) contacting the surface, an apparatus is known which utilizes a conductive transfer roller or corona electrification body as a transfer component. In the image forming apparatus, its transfer section is formed between the photoconductive body and transfer component by pressing or approximating the transfer component to the photoconductive body. The toner image on the photoconductive body is transferred onto the surface of the recording material by passing the recording material through the transfer section while supplying the transfer component with a transfer bias voltage opposite in polarity to the toner image on the photoconductive body.

As the photoconductive body used for the image forming apparatus, an organic photoconductive body (OPC photoconductive body) and an amorphous silicon photoconductive body (called "a-Si photoconductive body" from now on) are widely used. Among them, the a-Si photoconductive body has high surface hardness and high sensitivity to a semiconductor laser, and exhibits little deterioration caused by repeated use.

With such characteristics, the a-Si photoconductive body is used as an electrophotographic photoconductive body of a high-speed copying machine and laser beam printer (LBP). However, it has a variety of problems because it is produced through a process of transforming gas into plasma using high frequency or microwave, solidifying it, and forming a film by depositing it on an aluminum cylinder. More specifically, it is difficult to make the plasma uniform or to place the aluminum cylinder at the center of the plasma, and the film deposition conditions cannot be made uniform accurately all over the photoconductive body surface. Thus, a potential irregularity of about 20 volts occurs at developing locations all over the photoconductive body surface, and the potential irregularity offers a problem of causing density irregularity.

The potential irregularity is caused by: (1) the difference in charging ability because of the capacitance difference due to film thickness irregularity of the film deposition; and (2) the difference in potential attenuation characteristics caused by the local difference in the film quality because of the unevenness of the film deposition state.

Besides, using the a-Si photoconductive body brings about much larger post-charge potential attenuation than using the OPC photoconductive body even in a dark state. In addition, the potential attenuation is increased by an optical memory of image exposure. Accordingly, it is necessary to carry out pre-exposure before the charge to erase the optical memory due to the previous image exposure. The optical memory will be described here.

The image exposure after charging the a-Si photoconductive body will generate optical carriers, resulting in the potential attenuation. In this case, however, the a-Si photoconductive body has many dangling bonds (unbonded hands), which bring about a localized state that captures part of the optical carriers, thereby degrading their transit performance or reducing the recombination probability of the light-generating carriers. Accordingly, in the image forming process, part of the optical carriers generated by the exposure on the a-Si photoconductive body is released from the localized state simultaneously with the application of an electric field to the a-Si photoconductive body at the next step charging. Thus, the a-Si photoconductive body has a surface potential difference between the exposed section and the unexposed section, which constitutes the optical memory in the end.

Accordingly, it is common to erase the optical memory by making the optical carriers, which are latent within the a-Si photoconductive body, excessive and uniform all over the surface by carrying out uniform exposure with an exposure unit before charging. It is possible in this case to eliminate the optical memory (ghost) more effectively by increasing the light quantity of the pre-exposure emitted from a pre-exposure unit, or by bringing the wavelength of the pre-exposure closer to the spectral sensitivity peak of the a-Si photoconductive body (about 680-700 nm).

In this way, the optical memory can be erased by the pre-exposure. However, as described above, if the a-Si photoconductive body has the film thickness irregularity or the difference in the potential attenuation characteristics due to the film quality difference, electric fields applied between photoconductive layers change. This will cause a difference in the release of the optical carriers from the localized state, thereby bringing about potential irregularity at developing locations even if uniform charge is achieved at charging positions. In addition, as for the charging ability, since the capacitance becomes greater in such regions as the film thickness is reduced, it becomes disadvantageous, that is, as the charging ability reduces, the charging irregularity becomes conspicuous in the developing regions.

For these reasons, the potential attenuation becomes very large between the charging processing and developing processing, resulting in the potential attenuation of about 100 to 200 volts. As a result, the photoconductive body has a potential irregularity of about 10 to 20 volts all over its surface because of the foregoing film thickness irregularity and the difference in the potential attenuation characteristics. Since the a-Si photoconductive body, which has a large capacitance, has a lower contrast than the organic photoconductive body, the potential irregularity has a greater effect on the a-Si photoconductive body, thereby making the density irregularity more conspicuous. To solve these problems, the present inventor proposes an electrophotographic apparatus with a configuration that varies the exposure values in accordance with the potential attenuation characteristics of the image supporting body surface (see Japanese Patent Application Laid-open No. 2002-67387, for example).

The electrophotographic apparatus can provide good images without the density irregularity by correcting the potential attenuation characteristics of the image supporting body in the initial stage of the image supporting body. However, the potential attenuation characteristics of the image supporting body can vary over an extended period of use, thereby offering a problem of causing the density irregularity.

In addition, the initial characteristics of the apparatus can vary depending on its use environment, offering a problem of the density irregularity.

The present invention is implemented to solve the foregoing problems. It is therefore an object of the present invention to provide an image forming apparatus and method capable of forming good images without density irregularity even if the image supporting body varies with the passage of time.

SUMMARY OF THE INVENTION

To accomplish these objects, the image forming apparatus in accordance with the present invention includes: an image supporting body for forming an electrostatic latent image thereon; characteristic storing means for storing initial potential characteristics at individual positions on a surface of the image supporting body in advance in the form of a table; potential characteristic correcting means for compensating for differences in potential characteristics in accordance with the initial potential characteristics in the table stored in the characteristic storing means when forming the electrostatic latent image; developing means for adhering toner to the electrostatic latent image; and transfer means for transferring a toner image to a recording material; potential characteristic obtaining means for obtaining potential characteristics at a fixed position on the surface of the image supporting body; and characteristic difference calculating means for calculating potential characteristic differences between the potential characteristics obtained and the initial potential characteristics stored in the characteristic storing means, wherein the potential characteristic correcting means, using the calculated potential characteristic differences for the entire table stored in the characteristic storing means, for correcting the compensation for the differences in the potential characteristics.

The image forming method of forming an image with an image forming apparatus in accordance with the present invention includes: an image supporting body for forming an electrostatic latent image; characteristic storing means for storing initial potential characteristics at individual positions on a surface of the image supporting body in advance in the form of a table; potential characteristic correcting means for compensating for differences in potential characteristics in accordance with the initial potential characteristics in the table stored in the characteristic storing means when forming the electrostatic latent image; developing means for adhering toner to the electrostatic latent image; and transfer means for transferring a toner image to a recording material, the image forming method comprising: a potential characteristic obtaining step of obtaining potential characteristics at fixed positions on the surface of the image supporting body; and a characteristic difference calculating step of calculating potential characteristic differences between the potential characteristics obtained and the initial potential characteristics stored in the characteristic storing means, wherein by the characteristic correcting means, the potential characteristic difference correcting means, using the calculated potential characteristic differences for the entire table stored in the characteristic storing means, for correcting the compensation of in the potential characteristics differences.

It is possible to cause a program to execute the method, or to store the program for executing it in a computer readable medium.

As described above, varying the exposure values in accordance with the potential attenuation characteristics of the photoconductive body makes it possible to alleviate the potential irregularity in the developing regions in initial conditions of the photoconductive body. In addition, good images without the potential irregularity can be obtained by monitoring the changes in the photoconductive body surface state with the passage of time, by correcting the measurement means in accordance with the potential attenuation characteristic data, and by reflecting the changes with the passage of time obtained through the measurement means on the two-dimensional data of the potential attenuation characteristics.

Further features of the present invention will become apparent from the following description of exemplary embodiments (with reference to the attached drawings).

BRIEF DESCRIPTION OF THE DRAWINGS

FIG. 3 is a block diagram showing an example of potentials after exposure;

DESCRIPTION OF THE EMBODIMENTS

The image forming apparatus and method in accordance with the present invention will now be described with reference to the accompanying drawings.

Embodiment 1

Figure 1:
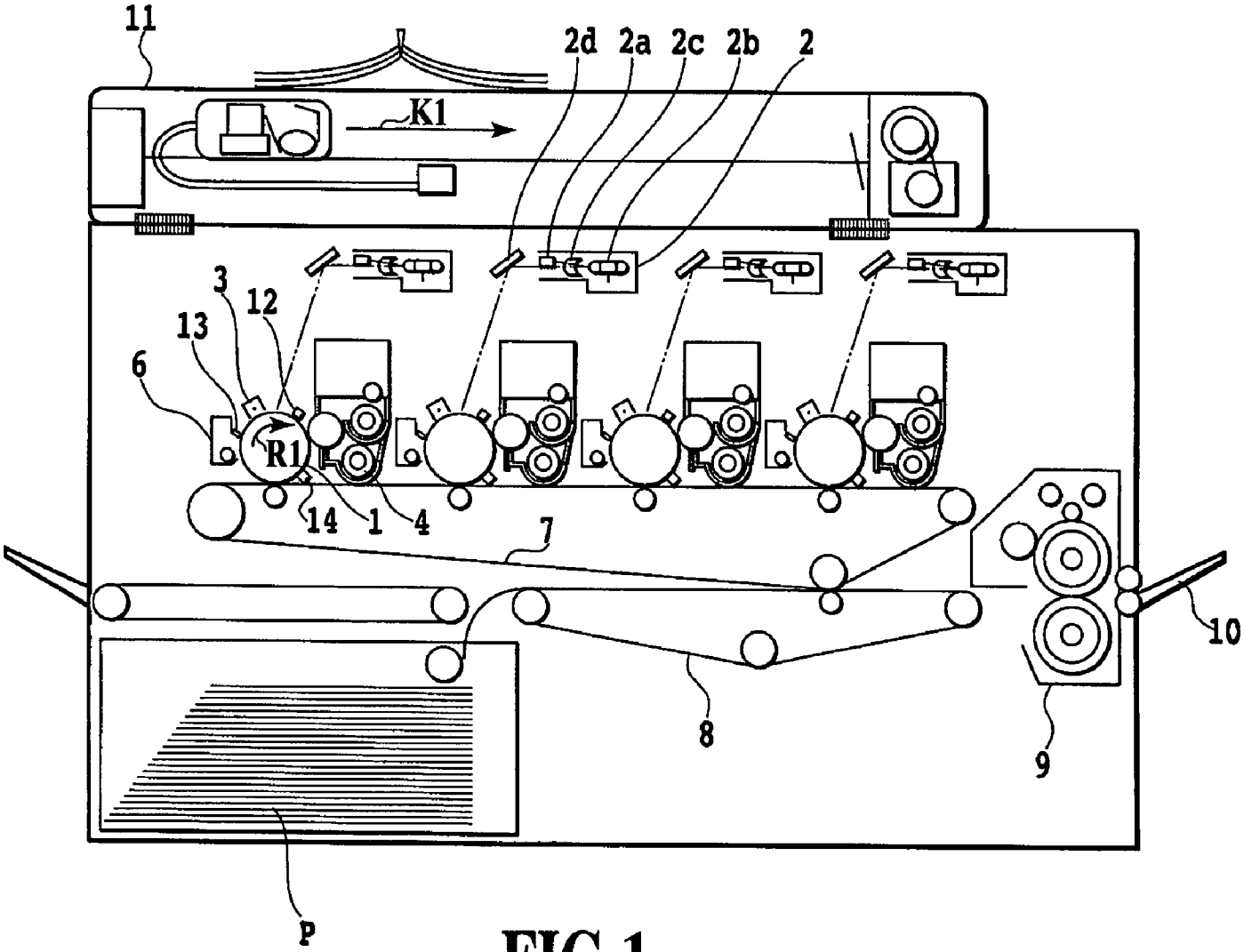
FIG. 1 is a cross-sectional view showing a schematic construction of an image forming apparatus in accordance with the present invention.

FIG. 1 shows an example of the image forming apparatus in accordance with the present invention. FIG. 1 is a longitudinal sectional view showing a schematic construction of a laser beam printer as the image forming apparatus. The image forming apparatus shown in FIG. 1 has a drum type electrophotographic photoconductive body (called "photoconductive drum" from now on) 1 as an image supporting body within the main body 50 of the image forming apparatus. Around the photoconductive drum 1, there are provided along its rotational direction an exposure unit 2, charging unit 3, developing unit 4, transfer unit 5, cleaning unit 6 and transfer belt 7. In addition, along the conveyance direction of a recording material (such as paper), a conveyor belt 8, fixing unit 9 and paper output tray 10 are disposed from the upstream side, and an image reading unit 11 is disposed at the top of the main body 50 of the image forming apparatus. The image forming apparatus of the present embodiment has for each color a set of these units necessary for the development with the photoconductive drum as the central unit in order to produce color images. In the example of FIG. 1, four sets of the units are shown to enable development in four color toners such as black (Bk), yellow (Y), cyan (C) and magenta (M). Accordingly, as for the exposure unit 2 for forming an electrostatic latent image, although it is provided for each color, the following description will be made about one of the exposure units.

The photoconductive drum 1 of the present embodiment has an a-Si photoconductive body layered on the outer surface of the aluminum cylinder. It is driven by a driving means (not shown) to rotate in the direction of the arrow R1 which is the direction of sub-scanning at a prescribed process speed. The photoconductive drum 1 will be described in more detail later. The photoconductive drum 1 has its surface charged uniformly at a prescribed polarity and a prescribed potential by the charging unit 3. As the charging unit 3, a noncontact corona electrification body can be used for the photoconductive drum 1, for example. On the photoconductive drum 1 after the charge, the exposure unit 2 forms an electrostatic latent image.

The image reading unit 11 has a light source movable in the direction of arrow K1 or in the direction opposite thereto. The light source irradiates the image side of a document placed on the document glass with its image side down. The reflected light from the image side is read by a CCD via a reflecting mirror and lenses (all of which are not shown). The image information read is supplied to the exposure unit 2 after passing through proper processing.

The exposure unit 2 has a laser oscillator 2*a,* polygon mirror 2*b,* lens 2*c,* reflecting mirror 2*d* and the like, and forms an electrostatic latent image by exposing the surface of the photoconductive drum 1 in response to the image information supplied from the image reading unit 11. The electrostatic latent image formed on the surface of the photoconductive drum 1 is developed to a toner image through the process of adhering toner with the developing unit 4. On the other hand, a recording material P in a paper cassette of a feed-conveyance unit is fed through paper feed rollers, and is put on the surface of the conveyor belt 8 across rollers by a conveyance roller.

The toner image formed on the photoconductive drum 1 by the developing unit 4 is transferred onto the surface of the recording material on the conveyor belt 8 by supplying the transfer belt 7 with a transfer bias opposite in polarity to the toner image. The recording material P having the toner image transferred is conveyed to the fixing unit 9 by the conveyor belt 8, has the toner image fixed on its surface through heat and pressure with the fixing roller and pressure roller, and is output to the paper output tray 10 thereafter.

Figure 5A:
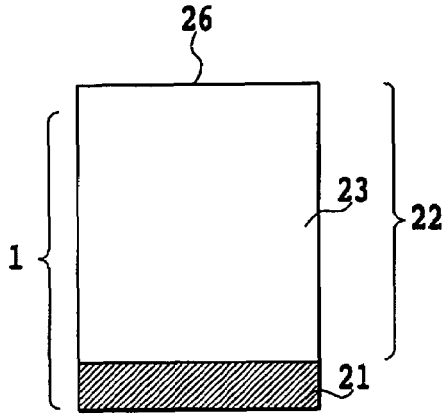
FIGS. 5A-5F are cross-sectional views showing correction of the photoconductive body of an embodiment in accordance with the present invention.

Next, the photoconductive drum 1 composed of an a-Si photoconductive body will be described in detail with reference to FIGS. 5A-5F, each of which schematically shows part of the photoconductive drum 1 above its shaft (which is placed under the bottom of each figure) in the longitudinal sectional view including the shaft of the photoconductive drum 1. FIG. 5A shows the photoconductive drum 1 that has a photosensitive layer 22 disposed on the surface of a cylindrical drum (supporting body) 21 used as the photoconductive body. The photosensitive layer 22 is composed of a photoconductive layer 23 that is composed of a-Si: H, X and has optical conductivity.

Figure 5B:
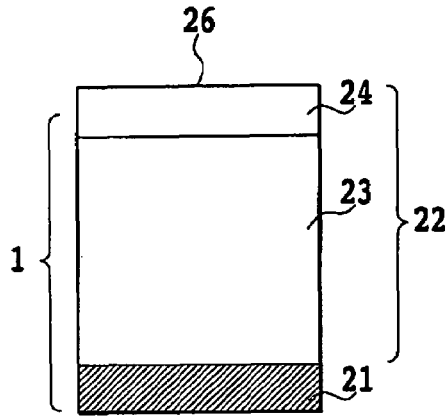
Figure 5C:
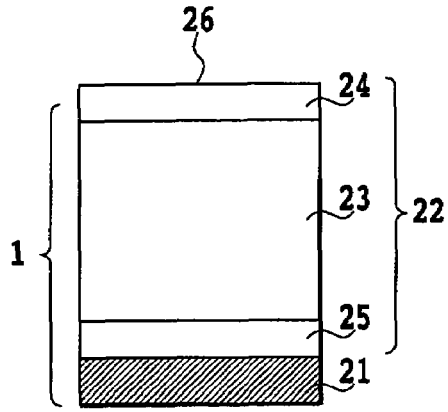
Figure 5D:
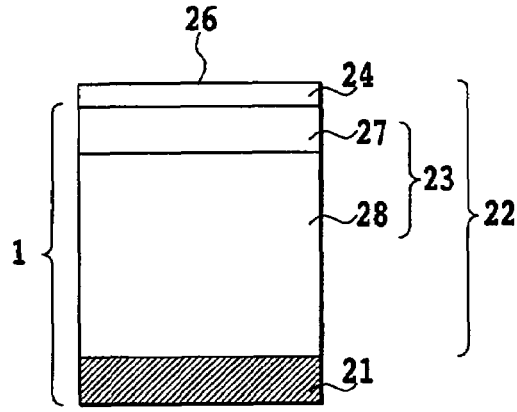
Figure 5E:
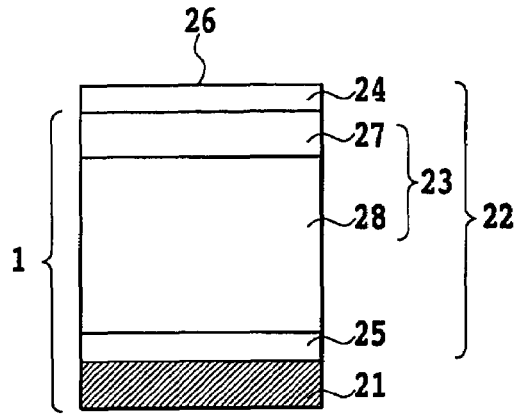
Figure 5F:
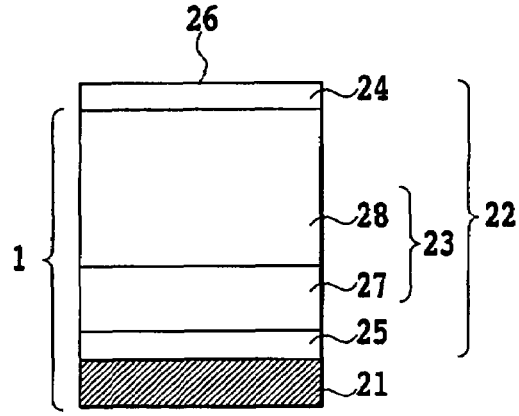

FIG. 5B shows the photoconductive drum 1 that has a photosensitive layer 22 disposed on the surface of the conductive drum 21 composed of aluminum and the like used as the photoconductive body. The photosensitive layer 22 is composed of a photoconductive layer 23 that is composed of a-Si:H, X and has optical conductivity, and an a-Si based surface layer 24. Furthermore, as shown in FIGS. 5C-5F, the photoconductive drum 1 can have an a-Si based charge-injection blocking layer 25; or can have the photoconductive layer 23 composed of a charge-generating layer 27 consisting of a-Si: H, X and a charge-transfer layer 28, and an a-Si based surface layer 24.

The charge-injection blocking layer 25 is provided as needed to prevent charges from flowing from the conductive drum 21 to the photoconductive layer 23. The drum 21 itself can have either a conductivity or an electrical insulation property resulting from conductivity process.

The photoconductive layer 23 constituting part of the photosensitive layer 22 is formed on the drum 21, or on an undercoat layer (not shown) as needed. The photoconductive layer 23 can be formed through a well-known thin film deposition process such as plasma CVD (p-CVD), sputtering, vacuum evaporation, ion plating, optical CVD and thermal CVD. As the p-CVD process, the process using a frequency band such as an RF band, VHF band and M band can be utilized. The foregoing layers are produced by a well-known apparatus and film forming method.

In the present invention, the layer thickness of the photoconductive layer 23 is appropriately determined to a desired thickness considering these factors that it provides desired electrophotographic characteristics, that the electrical capacitance in a used state falls within the foregoing range, and that it has economic effect, and is preferably 20-50 μm. The reference numeral 26 in FIGS. 5A-5F designates a free surface.

Next, a potential characteristic table and its adjustment, which are a feature of the present invention, will be described. The present invention has the following configuration to eliminate charging irregularity and density irregularity by extension caused by the difference in the potential attenuation characteristics all over the a-Si photoconductive body surface.

Each a-Si photoconductive body the present embodiment employs as the photoconductive drum 1 has a characteristic table representing the potential attenuation characteristics, which are the initial potential characteristics at the time of production of each a-Si photoconductive body. Thus, after charging the surface of each a-Si photoconductive body, the exposure unit carries out exposure at prescribed light quantities at exposure positions. After that, the surface potentials of each a-Si photoconductive body at developing locations are stored in advance in a memory chip (storing means) placed in the a-Si photoconductive body. The characteristic table divides the entire surface of the a-Si photoconductive body into appropriate number of blocks in accordance with the recording resolution in the optical scanning directions of the exposure unit 2, that is, in the main scanning direction (the longitudinal direction of the photoconductive body) and the sub-scanning direction (the rotational direction of the photoconductive body). Then, a potential attenuation characteristic map is prepared by storing data of the potential attenuation characteristics of the individual blocks.

Here, as for an appropriate area of the blocks, the entire surface of the photoconductive drum 1 (a-Si photoconductive body) is divided into 10 mm×10 mm blocks at the maximum size. In practice, blocks with a side amounting to 100 times a pixel corresponding to the recording resolution are preferable. When the recording resolution is 400 dpi, since 63.5 μm×100=6.35 mm, the surface is divided into blocks of 6.35 mm×6.35 mm. As for the preparation of the potential attenuation characteristic map, it need not be carried out with mounting the a-Si photoconductive body on the main body 50 of the image forming apparatus to which the a-Si photoconductive body is actually mounted.

The data of a potential attenuation characteristic map stored in the memory chip is read by a control unit (not shown) on the main body 50 side of the image forming apparatus when the photoconductive drum 1 (a-Si photoconductive body) is set to the main body 50 of the image forming apparatus. Then, according to the data of the individual blocks, the exposure values of the exposure unit 2 (the present embodiment uses a laser) are changed for the individual blocks recorded in the potential attenuation characteristic map so as to achieve uniform surface potential at the developing locations.

As for the correspondence between the potential attenuation characteristic map about the surface of the a-Si photoconductive body and the surface of the actual a-Si photoconductive body, contacts for transferring data from the memory chip that stores the data to the main body 50 of the image forming apparatus (which will be described later) are used as the point of reference. The point of reference always comes to the prescribed position in such a manner when the a-Si photoconductive body is stopped.

Figure 6:
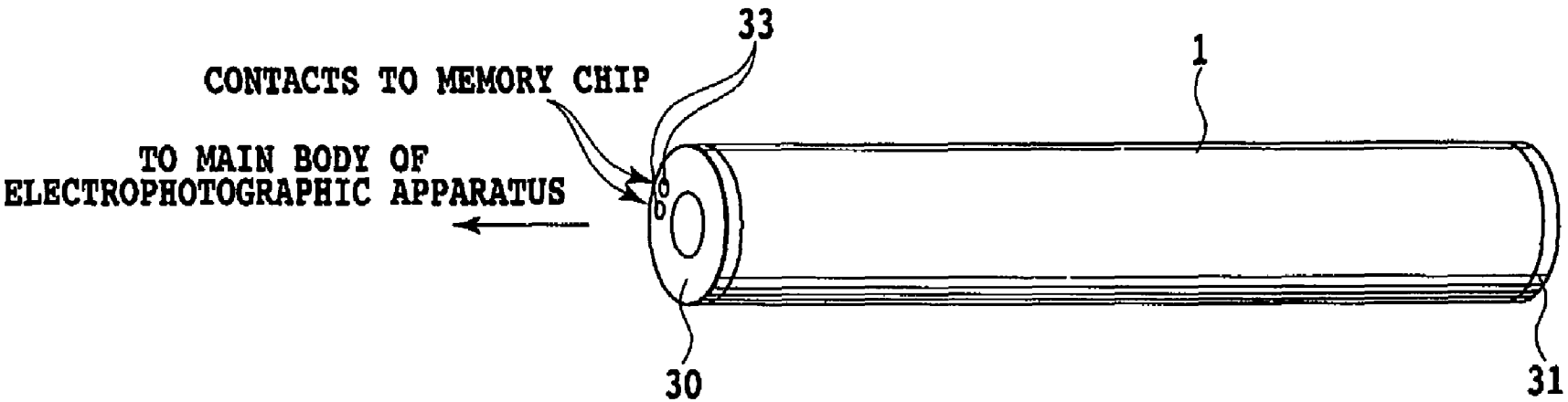
FIG. 6 is a perspective view showing contacts provided on the photoconductive drum 1 of an embodiment in accordance with the present invention.

As shown in FIG. 6, flanges 30 and 31 are fixed to both ends in the axial direction of the photoconductive drum 1 which is the a-Si photoconductive body. Among them, the flange 30 that becomes the leading edge when photoconductive drum 1 is installed in the main body 50 of the image forming apparatus has contacts 33 formed for a memory chip 32 (see FIG. 7(*a*)) in the drum. The main body 50 of the image forming apparatus reads the block data on the charging characteristics of the installed photoconductive drum 1 from the memory chip 32 via the contacts 33. Although the contacts 33 share the function of detecting position information in the present embodiment, this is not essential. FIG. 7(*a*) is a longitudinal sectional view showing a state in which the photoconductive drum is stationary, and the contacts at the photoconductive drum side are connected to the pins on the image forming apparatus side. FIG. 7(*b*) is a longitudinal sectional view showing a state in which the pins are disconnected from the contacts, and the photoconductive drum is rotatable.

Figure 7A:
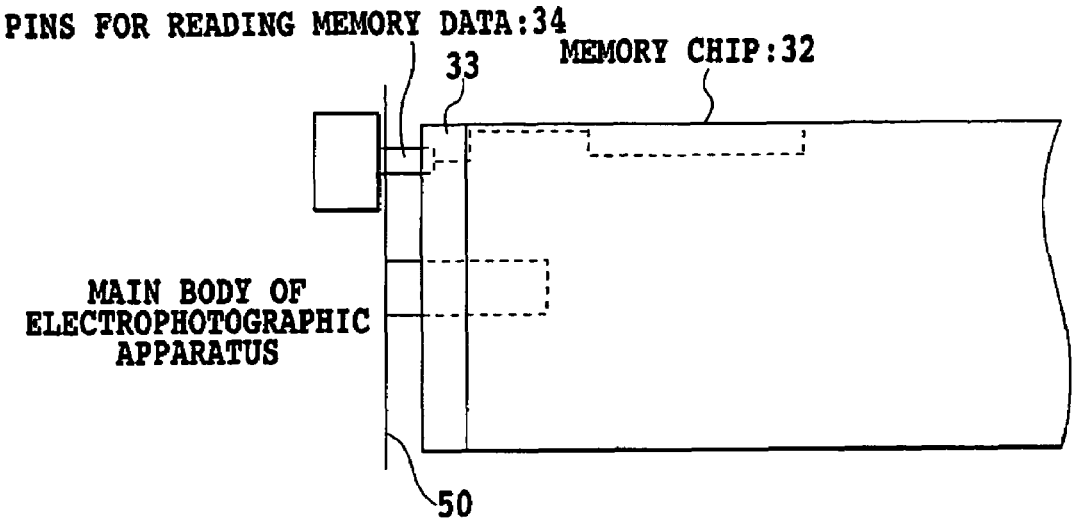
FIGS. 7A and 7B are each a longitudinal sectional view showing a relationship between the contacts on the photoconductive drum side and pins on the image forming apparatus side.
Figure 7B:
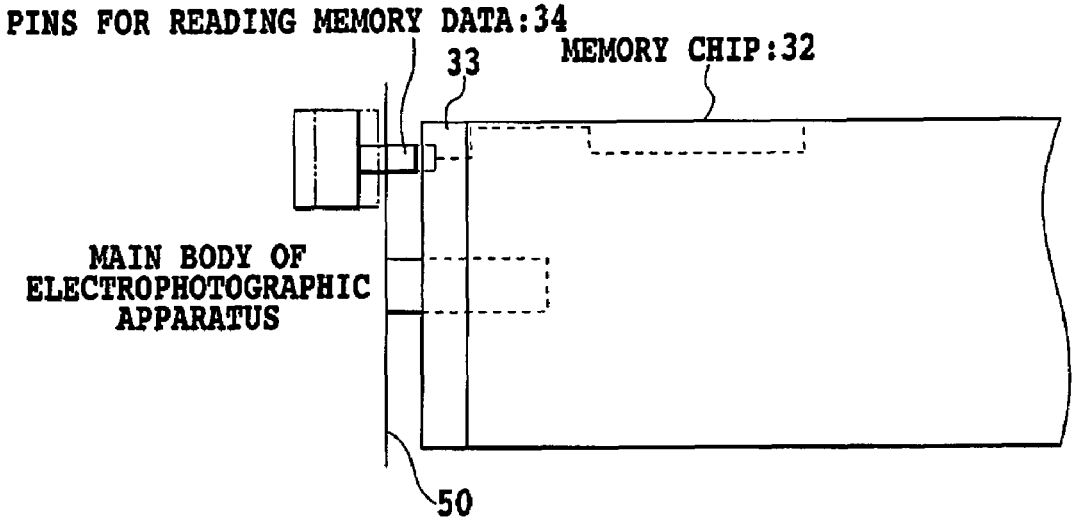

Next, a detecting method via the contacts 33 will be described. FIG. 7A shows the state in which the photoconductive drum is stationary and the pins 34 for reading the memory data, which are mounted on the main body 50 side of the image forming apparatus, are pressurized and fixed to the contacts 33. In contrast, FIG. 7B shows the state in which the drum is rotating. During the driving of the photoconductive drum, the pins 34 are removed from the pressure and disconnected from the contacts 33 so that the photoconductive drum 1 is rotatable freely. When the rotating photoconductive drum 1 is stopped, the pins 34 are pressurized and fixed to the contacts 33 immediately before stopping of the photoconductive drum 1, followed by stopping of the photoconductive drum 1.

Figure 8:
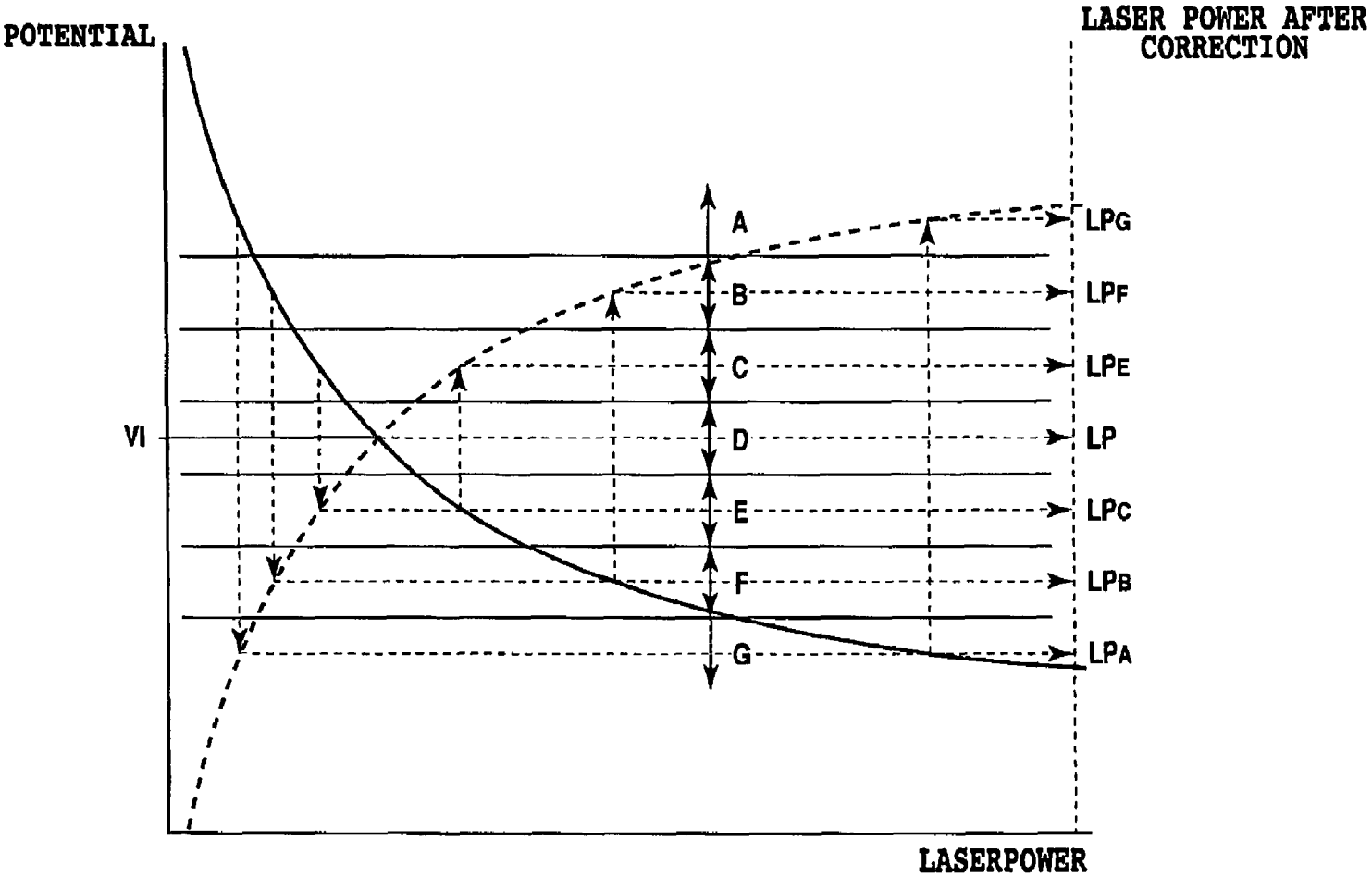
FIG. 8 is a diagram illustrating a relationship (EV curve) between exposure values and potentials of the photoconductive body of an embodiment in accordance with the present invention.

Next, referring to FIG. 8, facing relationships between the blocks set on the surface of the photoconductive drum and the image data divided into blocks. In FIG. 8, the axis of abscissas represents the exposure values (Laser Power), and the axis of ordinates represents the potentials on the surface of the photoconductive drum. In FIG. 8, the solid line is a graph (EV curve) between the exposure values and potentials of the photoconductive drum, and the broken line is a graph of the reciprocals, which is used for correcting the exposure values as will be described below. The potential after setting the exposure is Vl, and the exposure value in this case is LP.

According to the EV curve, the potential is divided into A-G. The potentials for correcting the median potentials of the ranges A-G to Vl are indicated by horizontal right arrows when looking at the inverse EV curve shown by the broken line, that is, LPA-LPG on the right axis of ordinates. The exposure values after the correction are used as the exposure values of the individual blocks on the surface of the photoconductive drum, that is, the exposure values for exposing the image in the regions corresponding to the blocks recorded on the memory chip 32.

Figure 2A:
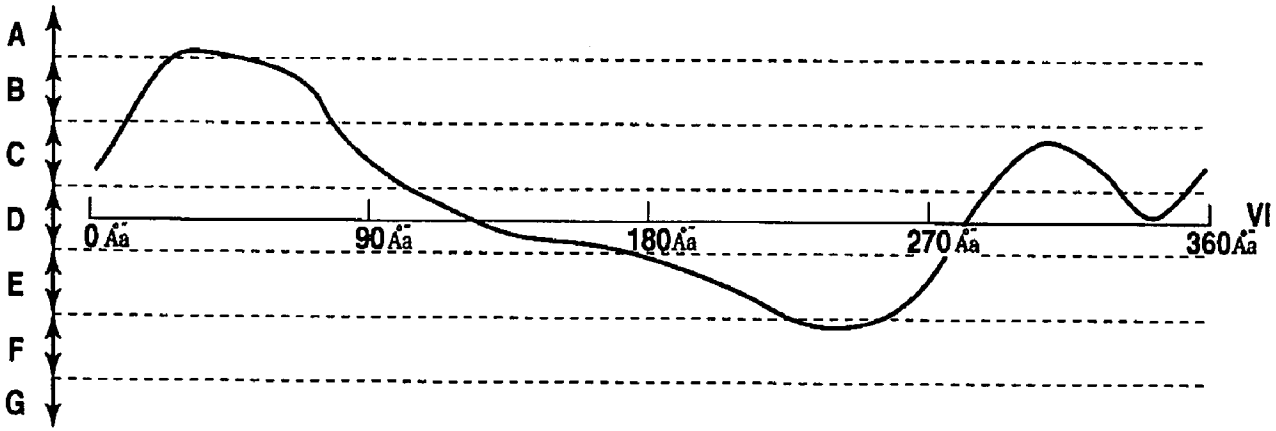
FIGS. 2A and 2B are a diagram illustrating an example of potential distribution on a photoconductive drum surface after exposure.
Figure 2B:
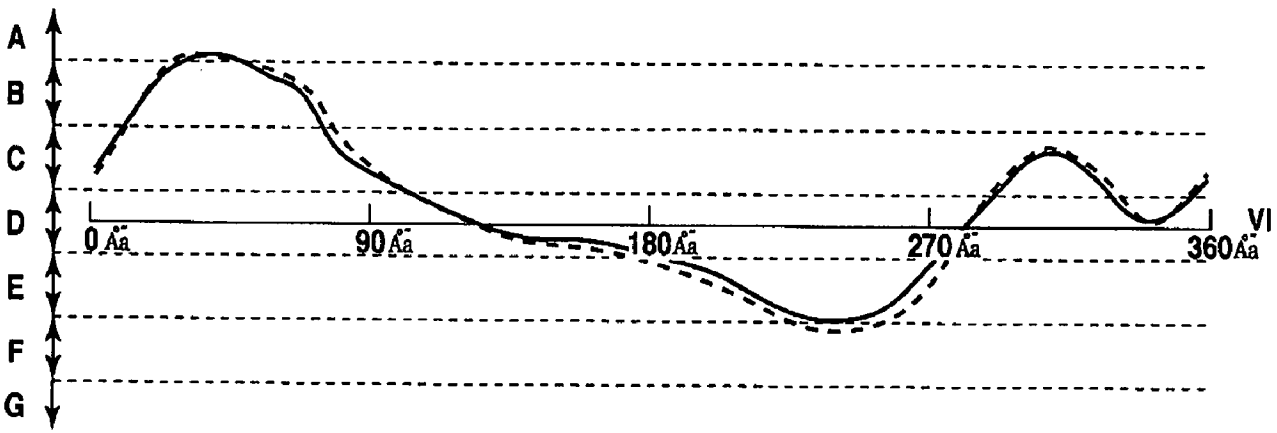
Figure 4:
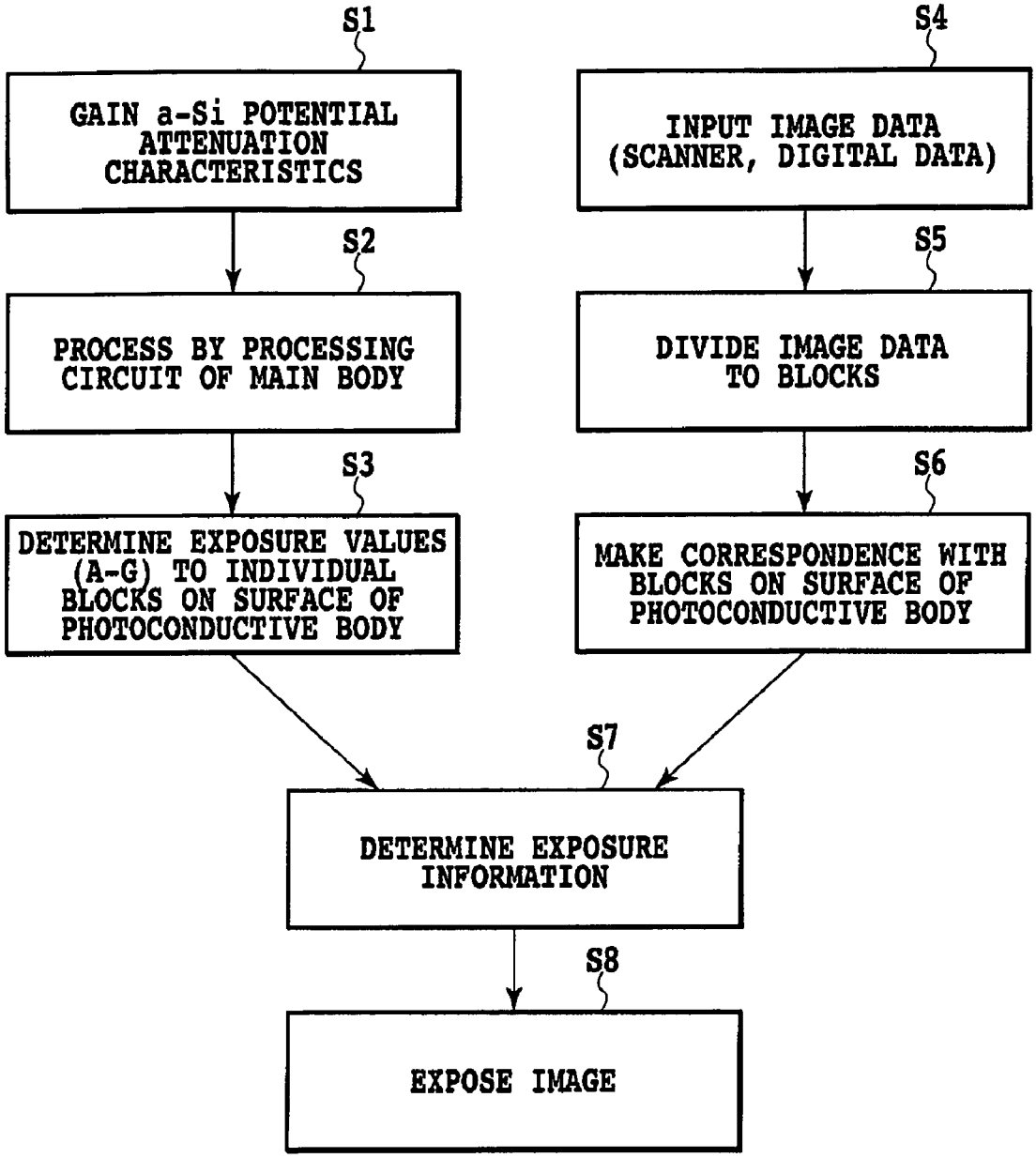
FIG. 4 is a flowchart illustrating image output processing of the present embodiment.

FIG. 4 is a flowchart illustrating the image output in the present embodiment. Before that, FIG. 3 shows deviations of the potentials from the prescribed potential Vl (which is set at 30 V in the present embodiment), which potentials are those at the developing locations after exposing the surface of the a-Si photoconductive body and are stored in the potential attenuation characteristic map. As shown in FIG. 3, the surface of the a-Si photoconductive body is compared with seven levels A-G divided at 6-V intervals. Thus, the individual blocks are checked which one of the ranges A-G they correspond to (step S1). The curves in FIGS. 2A and 2B represent the surface potentials (Vl) after the exposure by the exposure unit 2 in the main scanning direction on the surface of the a-Si photoconductive body.

A: range of (Vl+15 V)<A

B: range of (Vl+9 V)<B<(Vl+15 V)

C: range of (Vl+3 V)<C<(Vl+9 V)

D: range of (Vl−3 V)<D<(Vl+3 V)

E: range of (Vl−9 V)<E<(Vl−3 V)

F: range of (Vl−15 V)<F<(Vl−9 V)

G: range of G<(Vl−15 V)

According to the classification, the processing circuit (not shown) of the main body 50 of the image forming apparatus carries out the processing (step S2). Subsequently, the individual blocks all over the surface of the a-Si photoconductive body are divided into A-G as shown in FIG. 4. Then, the exposure values are set at seven levels in accordance with A-G so that the Vl of the individual blocks on the surface of the a-Si photoconductive body comes into the range D (step S3).

On the other hand, the input image is divided into blocks corresponding to the photoconductive body surface all over the image, followed by image processing (steps S4 and S5).

Subsequently, the blocks on the surface of the a-Si photoconductive body are brought into correspondence with the blocks of the input image processed (S6). Then, the laser light quantities (exposure information) for the individual blocks at the image exposure are determined (step S7), and according to the laser light quantities, the image exposure is carried out. As a result, the potentials at the developing locations after the exposure can be made uniform all over the surface of the a-Si photoconductive body. Thus, a good output image without the image irregularity can be obtained.

Although the foregoing description is made by way of example of the image forming apparatus employing the a-Si photoconductive body as the image supporting body with a particularly large effect, the present invention is also applicable to image supporting bodies other than the a-Si photoconductive body such as an OPC photoconductive body.

In the foregoing embodiment, the memory chip can be incorporated into the a-Si photoconductive body, or mounted on the body side of the image forming apparatus except for the a-Si photoconductive body. As a device for measuring the state of the photoconductive body surface, the present embodiment employs the potential sensor 12 as shown in FIG. 1. It is placed at the center of the longitudinal direction of the photoconductive body between the exposure processing and developing processing.

The correcting method of the potential sensor 12 according to the potential attenuation characteristic map of the photoconductive body, which is one of the features of the present invention, is carried out as follows. When a new photoconductive body is set, the potential data of FIG. 2B are obtained at the starting up of the machine by carrying out the charging processing to exposure processing and by measuring the potential around the photoconductive body with the potential sensor 12. According to the potential attenuation characteristic map attached to the photoconductive body, the one-dimensional potential data of FIG. 2A are calculated in the circumferential direction of the photoconductive body corresponding to the locations in the longitudinal direction of the potential sensor 12. Using the potentials of the potential data of FIG. 2A as reference values, the potential sensor 12 is subjected to the calibration using the potential data of FIG. 2B.

Figure 9:
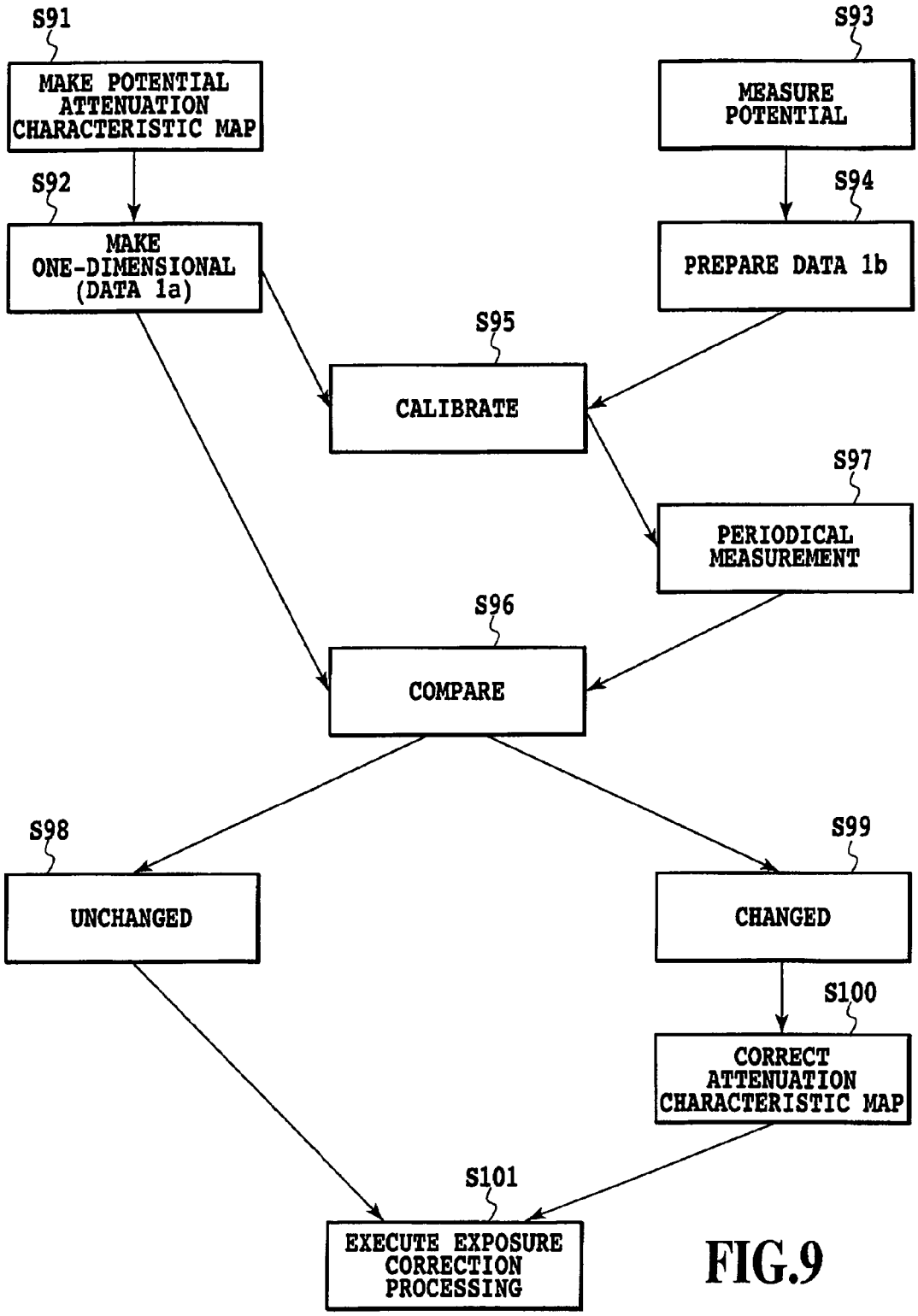
FIG. 9 is a flowchart illustrating processing from calibration to correction of the attenuation characteristics by a photoconductive body surface state measuring section (potential sensor in this case) of an embodiment in accordance with the present invention.

In addition, the reflection of the change of the photoconductive body with the passage of time on the potential attenuation characteristic map, which is one of the features of the present invention, is performed as follows. FIG. 9 is a schematic diagram illustrating a flow of performing processing in the present embodiment. The change of the photoconductive body with the passage of time at a central point is measured by the potential sensor 12 (S93). The timing of the measurement is set in accordance with the characteristics of the machine such as at every prescribed interval of sheets, at a prescribed time or at power-on. The present embodiment carries out the measurement at every 10-thousand sheet interval for correcting long term changes with time (S97). The measurement data thus obtained is compared with the potential data of FIG. 2A (S95). Then, under the assumption that the two-dimensional potential attenuation characteristic map has a uniform change all over the map, the differences from the potential data of FIG. 2A are added or subtracted (S99-S100). Using the newly obtained potential attenuation characteristic map, the exposure correcting processing is carried out, followed by the image output (S101). When no changes have occurred, the potential attenuation characteristic map is not corrected (S98).

As a result, in the long-term use of the machine, it is possible to reflect the potential attenuation characteristics of the photoconductive body on the entire surface of the photoconductive body, and to output good images without the density irregularity stably. In addition, it is possible to carry out short-term measurement (at the everyday starting up of the machine, for example) besides the long interval measurement of the potentials of the photoconductive body, and to reflect the results on the potential attenuation map. Thus, the fine fluctuations of the machine can be controlled, and hence good images without the density irregularity can be obtained stably.

Embodiment 2

Figure 10:
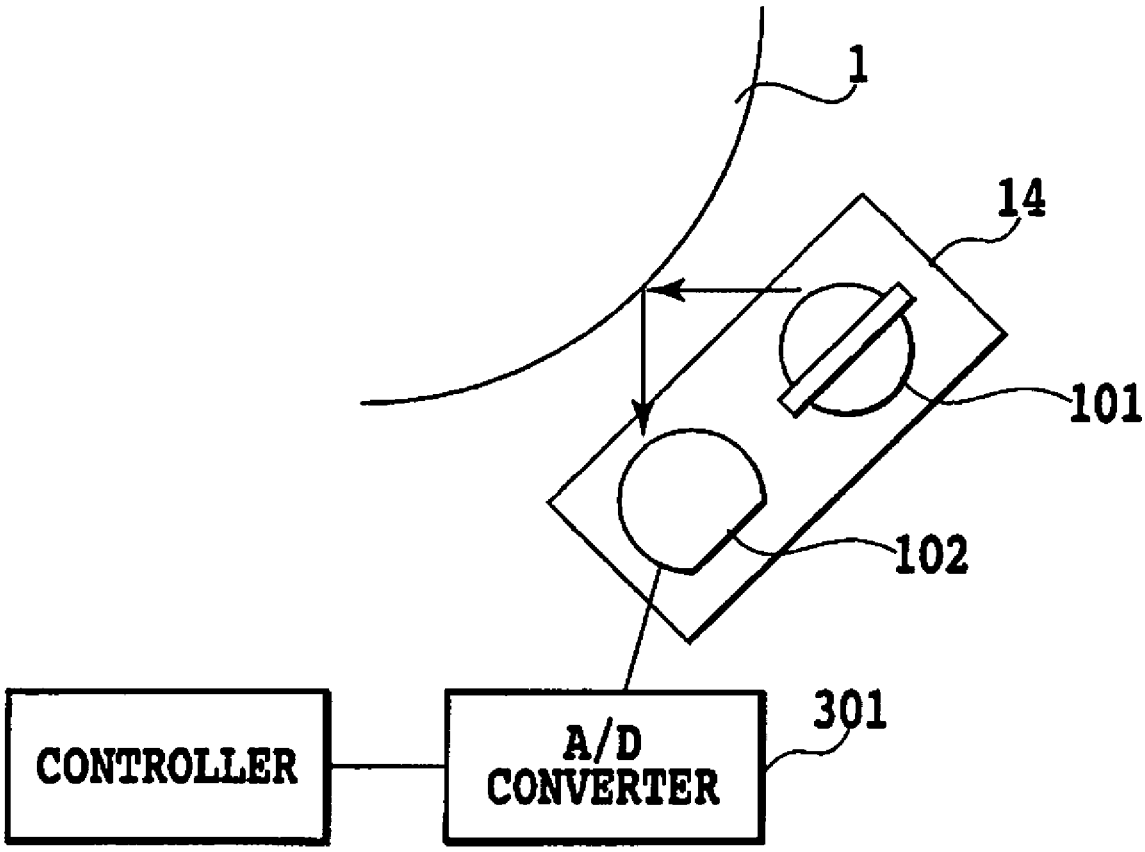
FIG. 10 is a schematic diagram illustrating a photosensor of an embodiment in accordance with the present invention.

The present embodiment employs, as a photoconductive body surface state measurement means, a method of carrying out density measurement of patches formed on the photoconductive body or transfer belt, which has been conventionally used for controlling the mixing ratio of the toner and carriers or for controlling the developing contrast.

a schematic diagram illustrating a flow of performing patch detecting processing that measures the density of the patches formed on the photoconductive drum 1 with the light quantity sensor 14 is discussed in the present embodiment. In FIG. 10, the photoconductive drum 1 has on its surface a region (image formed region) 103 on which an electrostatic latent image is formed and a region (non-image-formed region) 104 on which no electrostatic latent image is formed. The patches are formed on the non-image-formed region 104 in accordance with patch pattern information held by the pattern generator (not shown), and the patch density is measured by the light quantity sensor 14 composed of an LED 101 and a photosensor 102. The patches formed here consist of a plurality of patterns having prescribed density values for the individual colors of C, M, Y and K.

Next, a configuration for processing a signal fed to the photosensor 102 will be described. In FIG. 10, near-infrared light, which is reflected from the patches formed on the photoconductive drum 1 and is incident on the photosensor 102, is converted into an electric signal through the photosensor 102. After that, an A/D converter 301 converts the electric signal to a digital luminance signal having 0-255 levels across a 0-5 V output voltage. Then, a density converting circuit 302 converts the digital luminance signal to a density signal.

The correction of the light quantity sensor 14 according to the potential attenuation characteristic map of the photoconductive body is carried out by the following method. When a new photoconductive body is loaded, the light quantity sensor 14 develops a prescribed pattern around the photoconductive body 1 by carrying out the charging processing to exposure processing at the starting up of the machine. Thus, the photosensor 102 obtains the surface potential irregularity of the photoconductive body in terms of the luminance signal. According to the potential attenuation characteristic map attached to the photoconductive body, the one-dimensional potential data of FIG. 2A are calculated in the circumferential direction of the photoconductive body corresponding to the disposed position of the potential sensor 11 in the longitudinal direction. The potentials of the potential data of FIG. 2A are compared with data corresponding to a luminance signal obtained as the reference value, and the correcting values are obtained based on the differences from the potentials formed based on the pattern output from a pattern generator when the attenuation characteristics are flat.

The reflection of the change of the photoconductive body with the passage of time on the potential attenuation characteristic map is performed as follows as in the embodiment 1. The change of the photoconductive body with the passage of time at a central point is measured by the light quantity sensor 14. The timing of the measurement is set in accordance with the characteristics of the machine such as at every prescribed interval of sheets, at a prescribed time or at power-on. The present embodiment carries out the measurement at every 10-thousand sheet interval. The measurement data thus obtained is compared with the potential data of FIG. 2A, and under the assumption that the two-dimensional potential attenuation characteristic map has a uniform change all over the map, the differences from the potential data of FIG. 2A are added or subtracted. Then, by using the new potential attenuation characteristic map obtained, the exposure correcting processing is carried out, followed by the image output. As a result, the present embodiment has the same advantages as the first embodiment.

Embodiment 3

Using the potential sensor employed in the first embodiment in combination with the patch detecting means employed in the second embodiment makes it possible to correct the changes in the attenuation characteristics of the photoconductive body with the passage of time more accurately.

The present invention includes a potential characteristic obtaining means for obtaining potential characteristics at individual positions on the surface of the image supporting body; and a characteristic difference calculating means for calculating the potential characteristic difference between the potential characteristics obtained and the initial potential characteristics stored in the characteristic storing means. The characteristic correcting means corrects the compensation of the difference in the potential characteristics in accordance with the potential characteristic difference calculated. Thus, the present invention can provide an image forming apparatus and method capable of forming good images without density irregularity even if the image supporting body has the change with the passage of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-221585, filed Jul. 29, 2005 which is hereby incorporated by reference herein in its entirety.

What is claimed is:

1. An image forming apparatus comprising:

an electrophotographic photoconductive body for forming an electrostatic latent image thereon;

exposure means for exposing said electrophotographic photoconductive body to form an electrostatic latent image;

storing means for storing information related to potential characteristics at a plurality of areas divided on a surface of said electrophotographic photoconductive body in advance;

information obtaining means for obtaining the information related to potential characteristics, wherein light quantities exposed by said exposure means are determined according to the information related to potential characteristics stored by said storing means and the information related to potential characteristics obtained by said information obtaining means.

2. The image forming apparatus as claimed in claim 1, wherein said electrophotographic photoconductive body is an amorphous silicon photoconductive body.

3. The image forming apparatus as claimed in claim 1, wherein said information obtaining means includes potential measurement means for measuring a potential of said electrophotographic photoconductive body.

4. The image forming apparatus as claimed in claim 1, wherein said information obtaining means includes light quantity detecting means for detecting a quantity of light reflected from the formed electrostatic latent image.

5. The image forming apparatus as claimed in claim 1, wherein said potential characteristics are potential attenuation characteristics in the initial stage of the electrophotographic photoconductive body in response to the exposed light quantity.

6. An image forming apparatus comprising:

an image supporting body for forming an electrostatic latent image thereon;

characteristic storing means for storing initial potential characteristics at individual positions on a surface of said image supporting body in advance in the form of a table;

potential characteristic correcting means for compensating for differences in potential characteristics in accordance with the initial potential characteristics in the table stored in said characteristic storing means when forming the electrostatic latent image;

developing means for adhering toner to the electrostatic latent image; and transfer means for transferring a toner image to a recording material;

potential characteristic obtaining means for obtaining potential characteristics at a fixed position on said surface of said image supporting body; and characteristic difference calculating means for calculating potential characteristic differences between the potential characteristics obtained and the initial potential characteristics stored in said characteristic storing means, wherein said potential characteristic correcting means, using the calculated potential characteristic differences for the entire table stored in said characteristic storing means, for correcting the compensation for the differences in the potential characteristics.

7. The image forming apparatus as claimed in claim 6, wherein the initial potential characteristics at individual positions on said surface of said image supporting body are values obtained by dividing the surface of said image supporting body into areas with a prescribed size, and by obtaining potential characteristics in the individual areas in advance.

8. The image forming apparatus as claimed in claim 7, wherein the potential characteristics in the individual areas are obtained by measuring potential attenuation characteristics in the areas.

9. The image forming apparatus as claimed in claim 7, wherein the size of the areas is set in accordance with a resolution of the image formed on said image supporting body.

10. The image forming apparatus as claimed in claim 6, further comprising:

exposure means for forming the electrostatic latent image by exposing the surface of said image supporting body in a main scanning direction, wherein said surface of said image supporting body is a photoconductive layer composed of a non-single crystal material having silicon atoms as a base material and including at least one of hydrogen atoms and halogen atoms, and forms the electrostatic latent image while rotating in a sub-scanning direction of the exposure of said exposure means, and wherein said potential characteristic correcting means obtains the differences in the potential characteristics using the initial potential characteristics in the table stored in said characteristic storing means, calculates light quantities of said exposure means at individual positions on said surface of said image supporting body from the differences in the potential characteristics obtained, and provides compensation by exposing said surface of said image supporting body with the calculated light quantities.

11. The image forming apparatus as claimed in claim 10, wherein the areas are set by dividing said surface of said image supporting body in the main scanning direction and the sub-scanning direction in the optical scanning directions of said exposure means.

12. The image forming apparatus as claimed in claim 11, further comprising:

position detecting means for detecting a rotational position in the sub-scanning direction of said image supporting body, wherein said potential characteristic obtaining means obtains potential characteristics at positions detected.

13. The image forming apparatus as claimed in claim 6, wherein said image supporting body includes said characteristic storing means.

14. The image forming apparatus as claimed in claim 6, wherein said image supporting body does not include said characteristic storing means.

15. The image forming apparatus as claimed in claim 6, wherein said potential characteristic obtaining means obtains the potential characteristics through potential measurement means.

16. The image forming apparatus as claimed in claim 6, wherein said potential characteristic obtaining means obtains the potential characteristics by estimating a state of said surface of said image supporting body with light quantity detecting means.

17. An image forming method of forming an image with an image forming apparatus including:

an image supporting body for forming an electrostatic latent image thereon;

characteristic storing means for storing initial potential characteristics at individual positions on a surface of the image supporting body in advance in the form of a table;

potential characteristic correcting means for compensating for differences in potential characteristics in accordance with the initial potential characteristics in the table stored in the characteristic storing means when forming the electrostatic latent image;

developing means for adhering toner to the electrostatic latent image; and transfer means for transferring a toner image to a recording material, the image forming method comprising:

a potential characteristic obtaining step of obtaining potential characteristics at fixed positions on the surface of the image supporting body; and a characteristic difference calculating step of calculating potential characteristic differences between the potential characteristics obtained and the initial potential characteristics stored in the characteristic storing means, wherein the potential characteristic difference correcting means, using the calculated potential characteristic differences for the entire table stored in the characteristic storing means, for correcting the compensation of the potential characteristics differences.

18. The image forming method as claimed in claim 17, wherein the initial potential characteristics at individual positions on the surface of the image supporting body are values obtained by dividing the surface of the image supporting body into areas with a prescribed size, and by obtaining potential characteristics in the individual areas in advance.

19. The image forming method as claimed in claim 18, wherein the potential characteristics in the individual areas are obtained by measuring potential attenuation characteristics in the areas.

20. The image forming method as claimed in claim 18, wherein the size of the areas is set in accordance with a resolution of the image formed on the image supporting body.

21. The image forming method as claimed in claim 17, further comprising:

an exposing step of forming the electrostatic latent image by exposing the surface of the image supporting body in a main scanning direction, wherein the surface of the image supporting body is a photoconductive layer composed of a non-single crystal material having silicon atoms as a base material and including at least one of hydrogen atoms and halogen atoms, and forms the electrostatic latent image while rotating in a sub-scanning direction of the exposure in the exposing step, and wherein said potential characteristic correcting step obtains the differences in the potential characteristics using the initial potential characteristics in the table stored in the characteristic storing means, calculates light quantities in said exposing step at individual positions on the surface of the image supporting body from the differences in the potential characteristics obtained, and provides compensation by exposing the surface of the image supporting body with the calculated light quantities.

22. The image forming method as claimed in claim 21, wherein the areas are set by dividing the surface of the image supporting body in the main scanning direction and the sub-scanning direction in the optical scanning directions in the exposing step.

23. The image forming method as claimed in claim 22, comprising:

a position detecting step of detecting a rotational position in the sub-scanning direction of the image supporting body, wherein the potential characteristics are obtained at positions detected.

24. The image forming method as claimed in claim 17, wherein said potential characteristic obtaining step obtains the potential characteristics though potential measurement means.

25. The image forming method as claimed in claim 17, wherein said potential characteristic obtaining step obtains the potential characteristics by estimating a state of the surface of the image supporting body with light quantity detecting means.

26. A computer readable recording medium embodying a program for causing a computer to execute said steps as defined in claim 17.

* * * * *